United States Patent [19]

Cero

[11] Patent Number: 4,831,996

[45] Date of Patent: May 23, 1989

[54] TARGET PROJECTING APPARATUS

[76] Inventor: Larry J. Cero, 14809 Timber Lake Rd., Wichita, Kans. 67230

[21] Appl. No.: 61,149

[22] Filed: Jun. 5, 1987

Related U.S. Application Data

[63] Continuation-in-part of Ser. No. 889,356, Jul. 25, 1986, abandoned.

[51] Int. Cl.[4] ..... F41B 3/04

[52] U.S. Cl. ..... 124/8; 124/36; 74/2; 185/40 R

[58] Field of Search ..... 124/7, 8, 9, 32, 34, 124/47, 50, 36; 74/2; 185/40 R

[56] References Cited

U.S. PATENT DOCUMENTS

| | | | |
|---|---|---|---|
| 829,963 | 9/1906 | Haughawout | 124/8 |
| 1,475,713 | 11/1923 | Napier | 124/8 |
| 2,078,166 | 4/1937 | Schwerin | 124/8 |
| 2,668,526 | 2/1954 | Woolsey | 124/9 |
| 3,070,082 | 12/1962 | Foster | 124/8 |
| 3,677,257 | 7/1972 | Segerkvist | 124/8 |
| 3,826,238 | 7/1974 | Hansen | 124/36 X |
| 3,971,357 | 7/1976 | Laporte et al. | 124/8 |
| 4,289,038 | 9/1981 | Hore | 74/2 |
| 4,300,520 | 11/1981 | Laporte | 124/9 |

FOREIGN PATENT DOCUMENTS

| | | | |
|---|---|---|---|
| 2303262 | 11/1976 | France | 124/36 |
| 2377603 | 9/1978 | France | 124/36 |

*Primary Examiner*—Randolph A. Reese
*Assistant Examiner*—John A. Ricci
*Attorney, Agent, or Firm*—John Wade Carpenter

[57] ABSTRACT

A target projecting apparatus having a main support housing assembly, and a target conveyance assembly mounted to the main support housing assembly. Also mounted or connected to the main support housing assembly are a target drive assembly, a releasing assembly, and a switch for interrupting power to a sprocket support that is included in the target drive assembly. A method for throwing targets comprising interrupting power to stop the sprocket support from rotating, and tripping a safety latch to release a spring biased crank shaft in order to propel a target.

20 Claims, 10 Drawing Sheets

FIG. 1
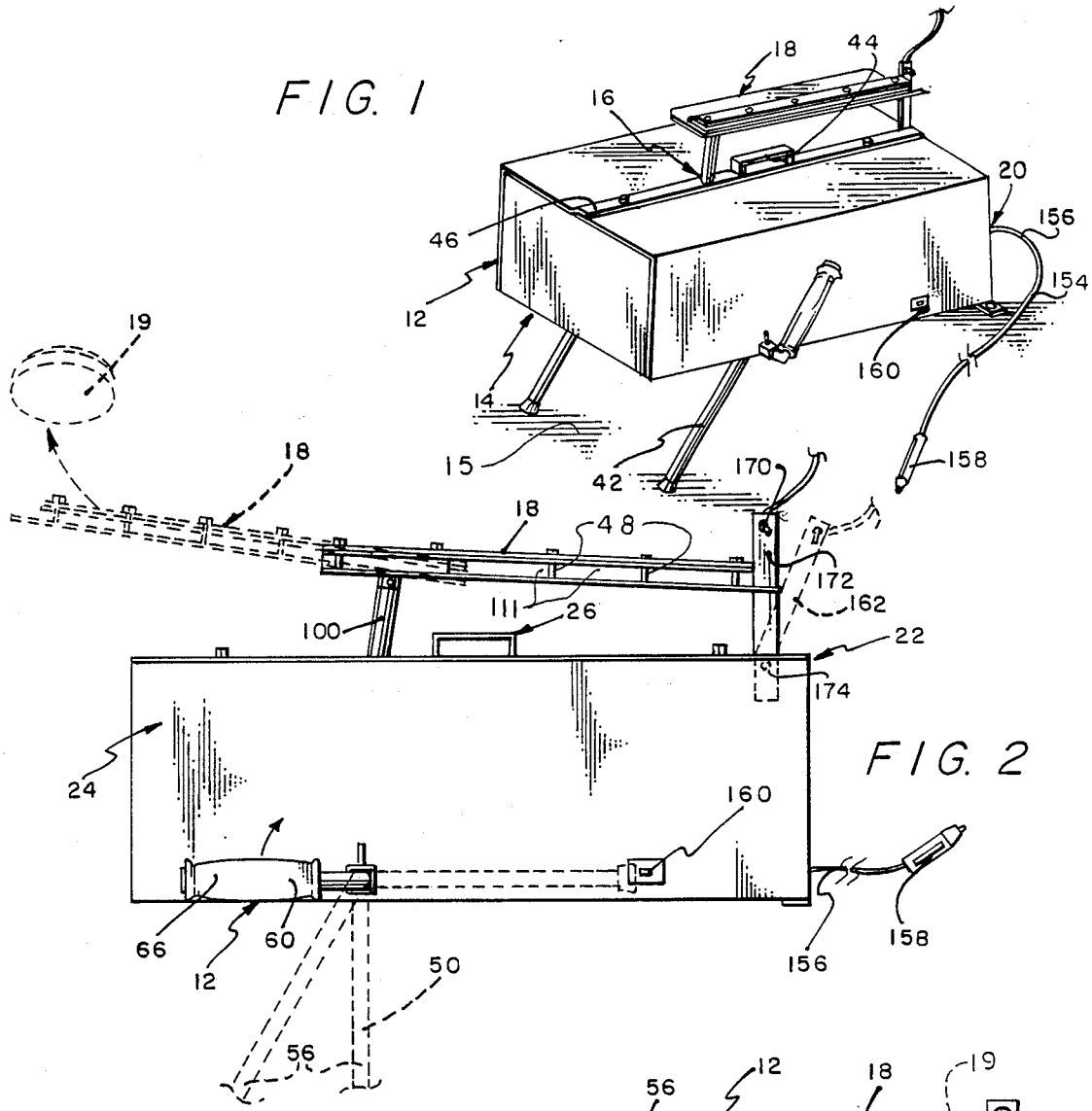
FIG. 2
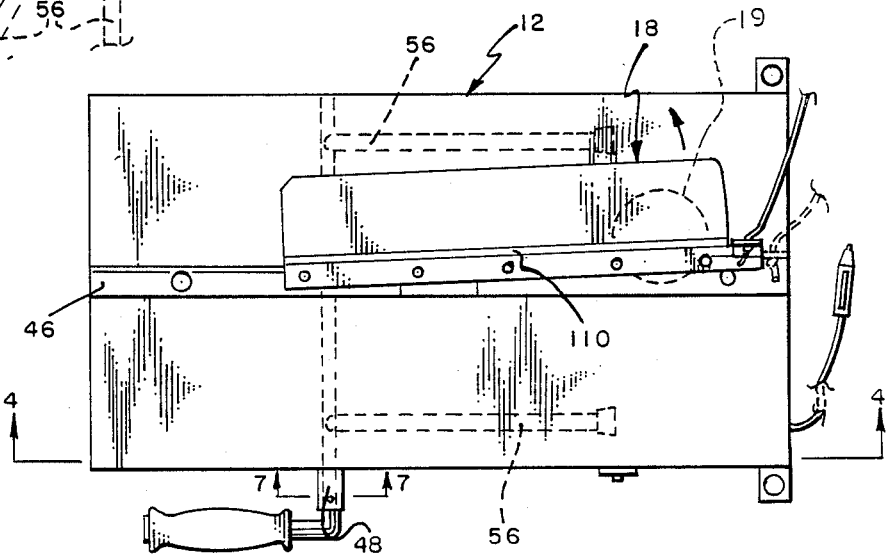
FIG. 3

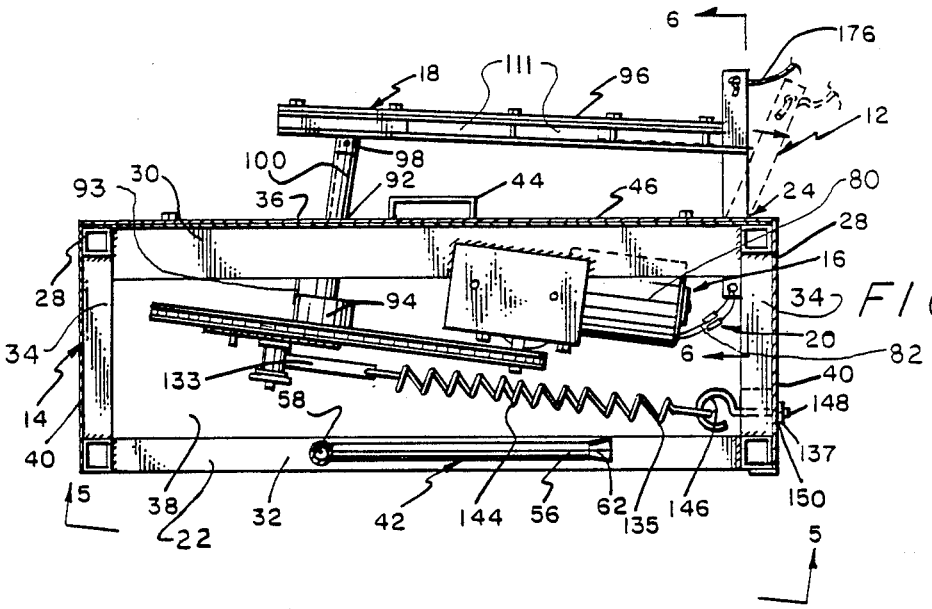
FIG. 4
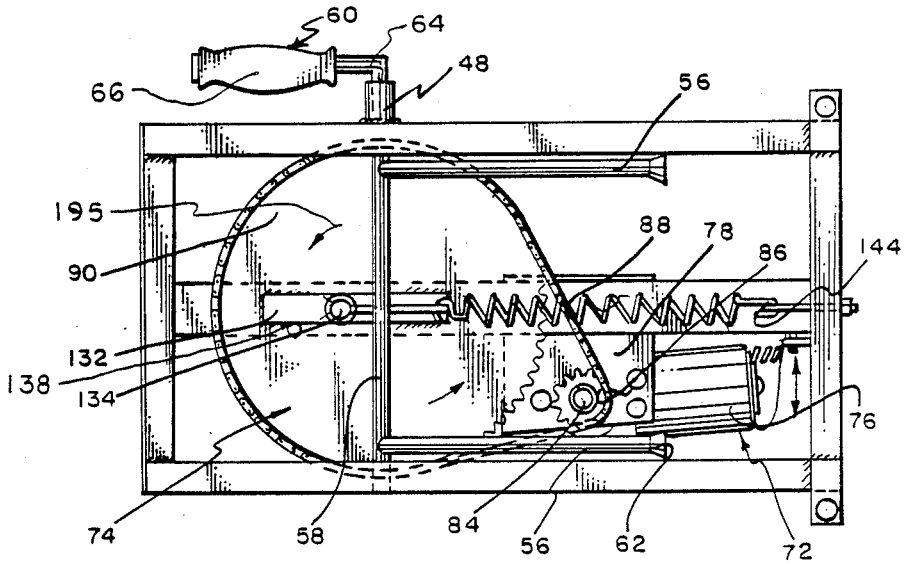
FIG. 5
FIG. 6
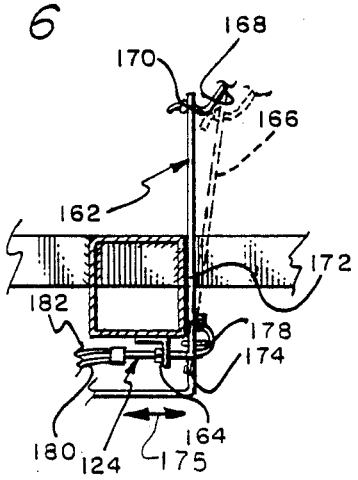
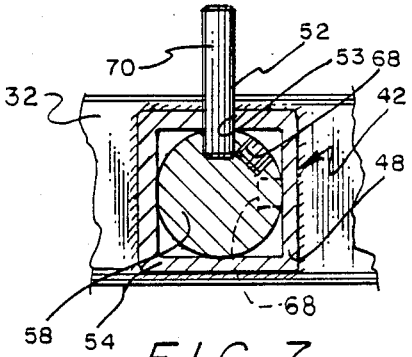
FIG. 7

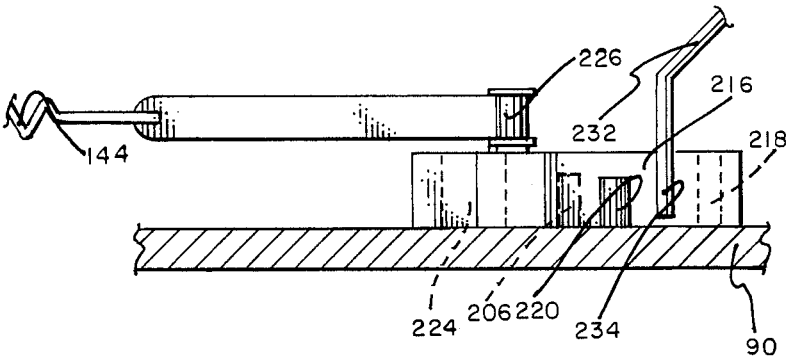
FIG. 14
FIG. 15
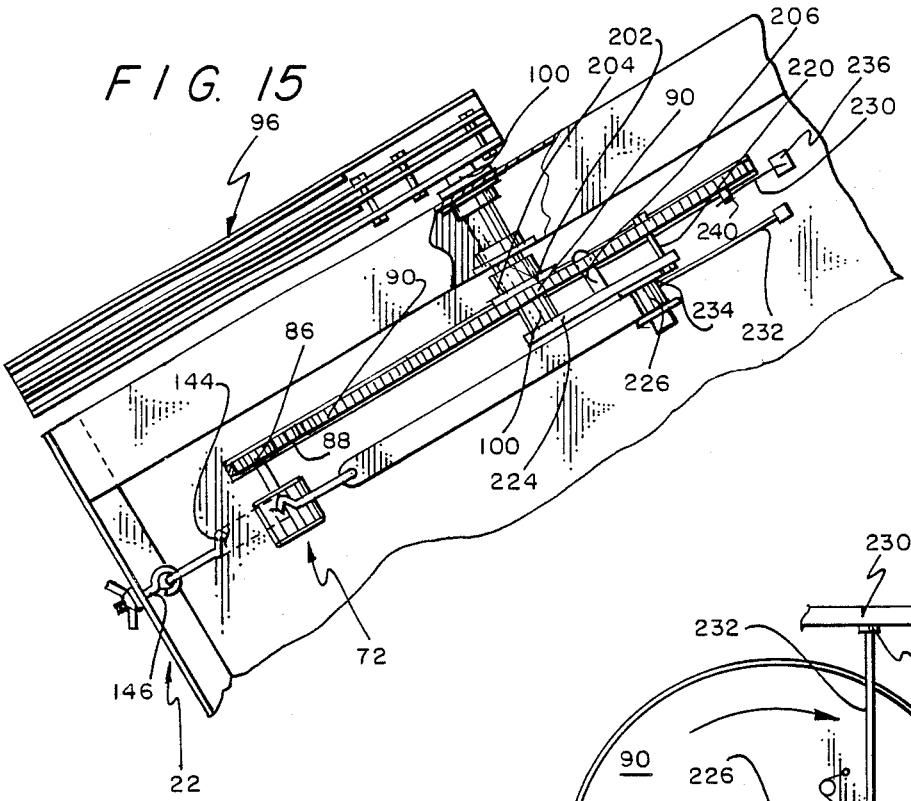
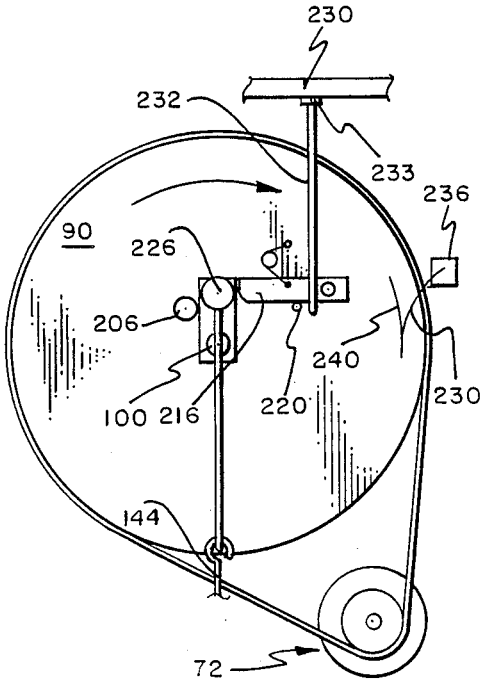
FIG. 16

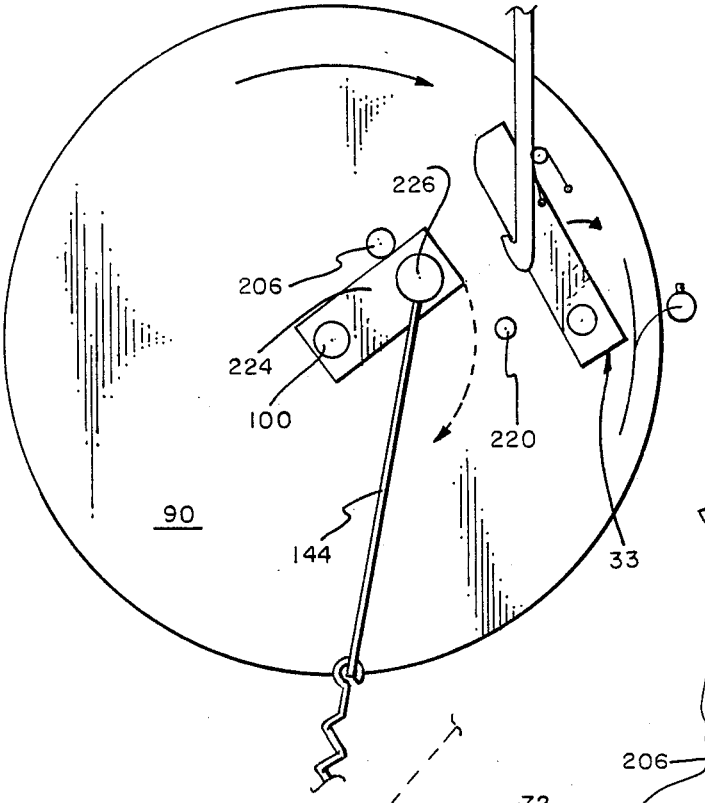
FIG. 19
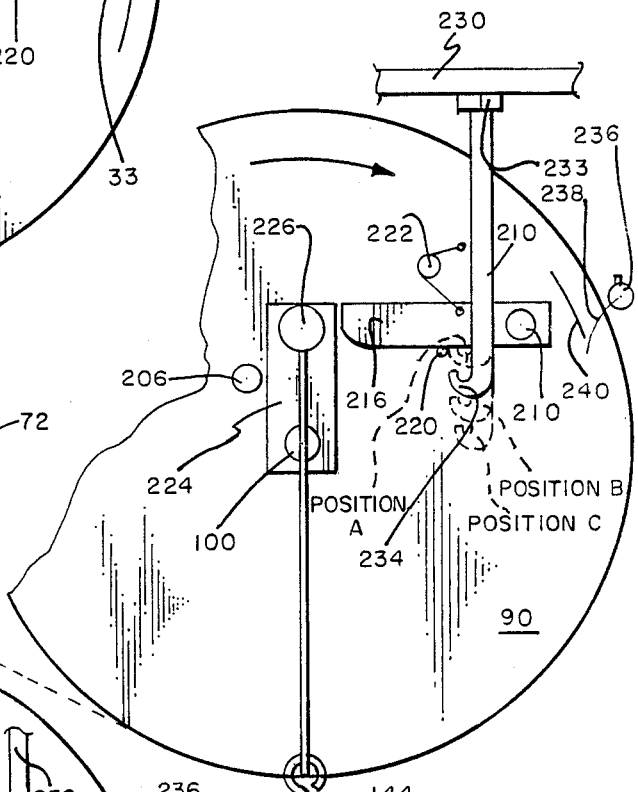
FIG. 21
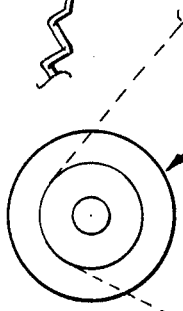
FIG. 20
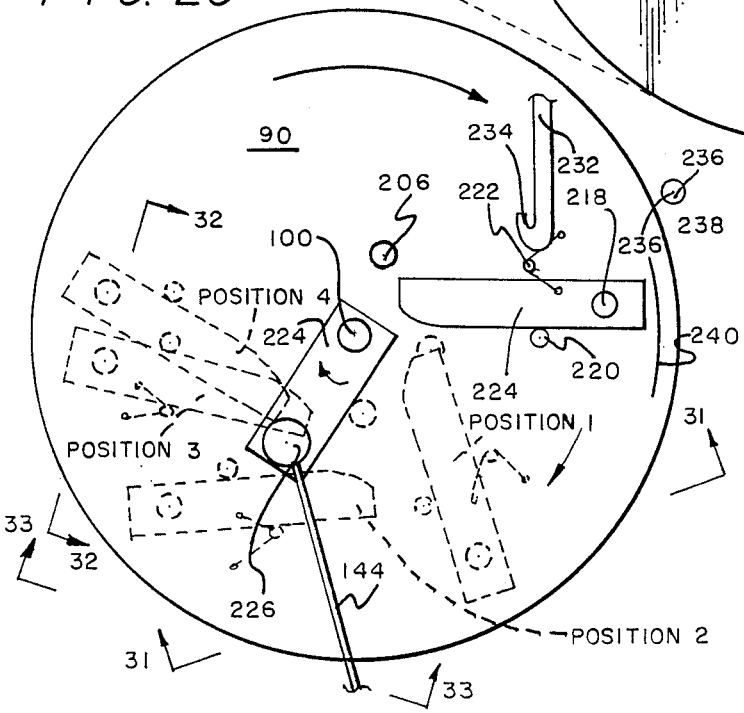

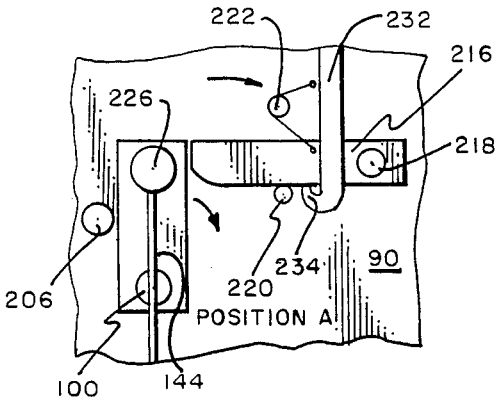
FIG. 22
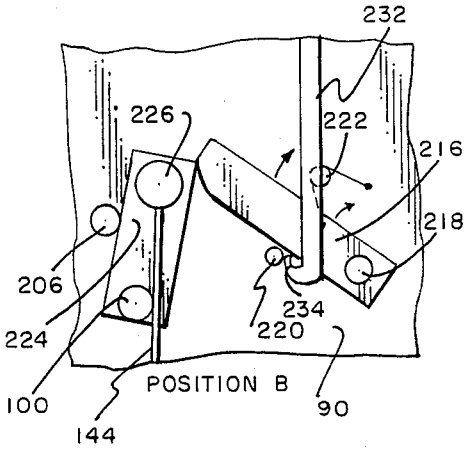
FIG. 23
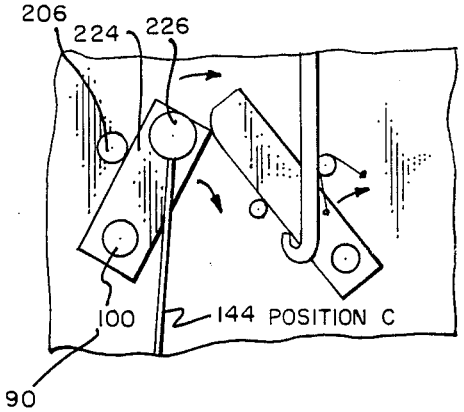
FIG. 24
FIG. 25
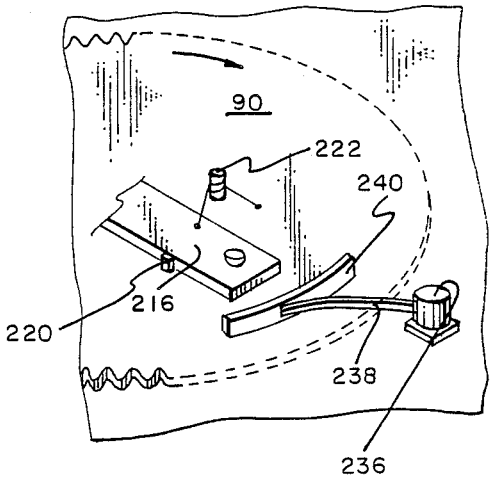
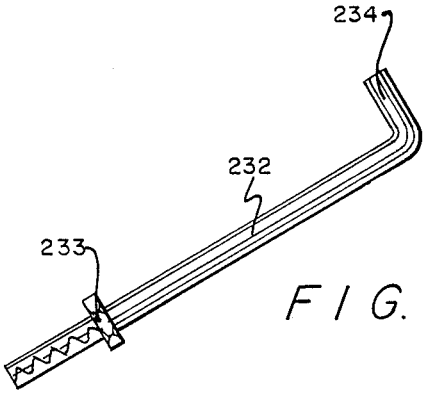
FIG. 26

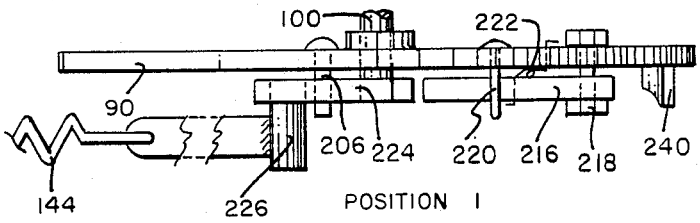
FIG. 31
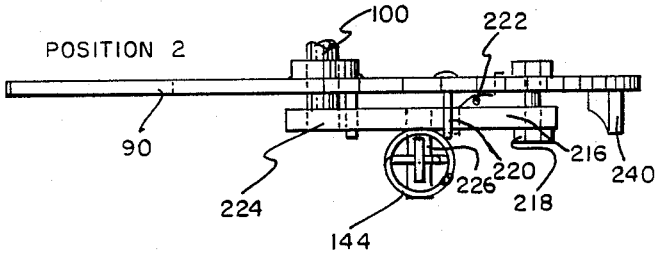
FIG. 32
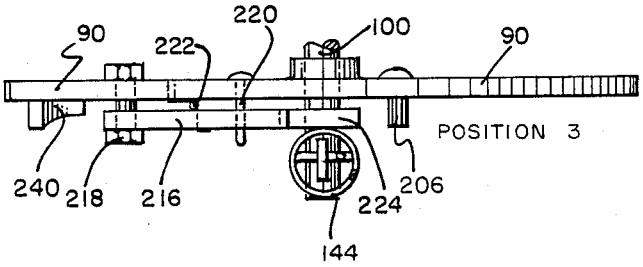
FIG. 33
FIG. 34
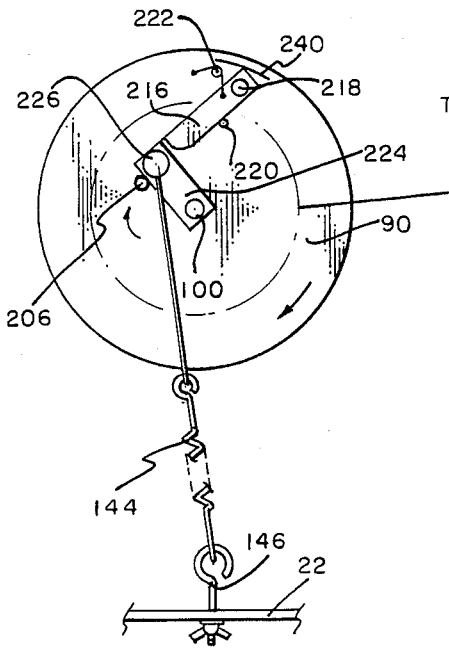
FIG. 35
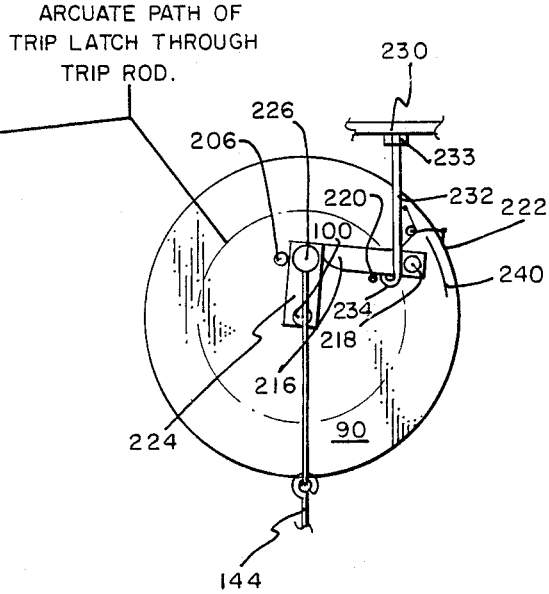

TARGET PROJECTING APPARATUS

This is a continuation-in-part application of my copending application Ser. No. 889,356, filed July 25, 1986, now abandoned. Benefit of the July 25, 1986 filing date with respect to subject matter common in the copending application and the following application is claimed.

A patentability investigation was conducted on clay pigeon throwing type apparatuses operable to be powered through a 12-volt DC power source having a throwing arm which is loaded, released, and automatically reloaded to receive and throw a clay pigeon therefrom. The patentability investigation revealed the following United States patent references.

| Reg. No. | Invention | Inventor |
|---|---|---|
| 1,475,713 | MOTOR DRIVEN TARGET THROWING MACHINE | Napier |
| 2,078,166 | THROWING MACHINE | Schwerin |
| 3,088,452 | TARGET THROWING APPARATUS | Foster |
| 3,093,127 | TARGET-THROWING DEVICE | Starr |
| 3,677,257 | SPRING TYPE DISC PROJECTING DEVICE WITH CAM OPERATED COCKING MECHANISM | Segerkvist |
| 4,300,520 | TARGET THROWING DEVICE | Laporte et al |

The Laporte et al, Foster, and Schwerin patent disclose rather complex throwing apparatuses. For example, the Laporte et al device discloses a device including numerous adjustable features having a pin member on a crank arm being operable to contact a driven pin to load a spring. However, this patent does not have the other features of my invention regarding a micro switch, automatic operation, etc.

The Schwerin patent discloses a rather expensive and complex structure which operates with a spring moved beyond dead center so that the spring will move the throwing arm member through its throwing angle. The throwing arm is held in the loaded condition by a trip latch.

The Foster patent is rather difficult to understand and is a very expensive, complex mechanism with an automatic type loading device to load stacks of clay pigeons.

The Napier patent discloses a structure utilizing a sprocket driven motor structure so as to move a pigeon throwing arm to the loaded condition.

The Starr patent discloses a rather complex electrical system as shown in FIG. 19. This device uses a solenoid operated clutching system to engage the throwing arm with the drive motor to tension a spring member to provide the power for releasing the throwing arm.

The Segerkvist patent utilizes a cam feature for automatically loading clay pigeons.

Although numerous clay pigeon type throwing devices are noted, none are operable in a compact, efficient manner on an automobile battery power source similar to the applicant's invention. Additionally, many of the prior art devices are very complex in structure, expensive to manufacture, and cannot be readily grasped, lifted by one person, and conveyed in a trunk of a motor vehicle to the site to be used.

PREFERRED EMBODIMENT OF THE INVENTION

In one preferred embodiment of the invention, a target projecting apparatus is operable to receive clay pigeons thereon for throwing in various arcuate paths for shooting thereof by a person practicing hunting techniques duplicating the shooting of wild birds in flight such as ducks, quail, pheasant, and the like.

The target projecting apparatus in one embodiment includes (1) a main support housing assembly operable to be supported on a ground surface, table, or the like; (2) a target drive assembly mounted on main support housing assembly; (3) a target conveyance assembly connected to the target drive assembly and operable to receive the clay pigeons thereon; and (4) a projector actuator and control assembly having means therein to load and control movement of the target conveyance assembly. The main support housing assembly includes a basic support frame; a main cover assembly enclosing the basic support frame; and a support conveyance assembly having a handle member thereon in order to readily convey the entire target projecting apparatus. The target drive assembly includes a main drive assembly connected to an actuator sprocket assembly so as to provide movement of a main drive sprocket member through a drive chain member and a drive motor member in order to provide for the cocking and loading of the target conveyance assembly. The target conveyance assembly includes a throwing arm assembly connected to a shaft member to the target drive assembly whereupon the throwing arm assembly is subsequently moved from the discharge position to a locked, cocked, position and, then, to be released position whereupon the throwing arm assembly is moved through a loaded tension spring member which then projects a clay pigeon member therefrom.

In another embodiment of the invention, the target projecting apparatus comprises (a) a main support housing assembly having a basic support frame;

(b) a target conveyance assembly mounted to the main support housing assembly including a throwing arm assembly and a crank shaft means which is connected to the throwing arm assembly and includes a shaft;

(c) a target drive assembly connected to the main support housing assembly and comprising a sprocket support means having a structure defining an aperture wherethrough the shaft rotatably passes, power means secured in the main support housing means for rotating the sprocket support means, a drive lug means bound integrally to the sprocket support means, and a means secured to the sprocket support means for latching and tripping the crank shaft means;

(d) a releasing assembly secured to the basic support frame from releasing the means for latching and tripping and for controlling acceleration of a target from the throwing arm assembly; and (e) a means secured to the basic support frame for interrupting the power means from rotating the sprocket support means.

In yet another embodiment of the invention, there is provided a method for throwing targets such as clay pigeons and the like in a variable path comprising the steps of:

(a) mounting on a sprocket support means a switch activator strip means and a means for latching and tripping a spring biased crank shaft means rotatably passing through the sprocket support means and having secured thereto a throwing arm assembly;

(b) placing a target on the throwing arm assembly;

(c) rotating the sprocket support means with a drive means engaged to a power source such that said means for latching and tripping latches the spring biased crank shaft means and rotates the same;

(d) interrupting the power source to the drive means to stop the sprocket support means from rotating; and (e) tripping the means for latching and tripping to release the latch on the spring biased crank shaft means such that the throwing arm assembly is propelled by the released spring biased crank shaft to throw the target, said tripping comprises overriding the interrupting of the power source to the drive means to restart the rotation of the sprocket support means causing the means for latching and tripping to rotate into a trip rod means rotatably mounted to a frame means.

OBJECTS OF THE INVENTION

One object of this invention is to provide a target projecting apparatus which is of relatively light weight and easy to lift and convey being compact requiring little space for conveyance and storage.

Another object of this invention is to provide a target projecting apparatus having a target conveyance assembly with a throwing arm assembly operable to receive clay pigeons in various positions thereon to control and alternate the distance and arcuate path of travel therefrom.

One further object of this invention is to provide a target projecting apparatus having a main support housing assembly with a support stand assembly which is (1) adjustable to provide for various angles of inclination for clay pigeon target throwing, and, (2) foldable into a compact conveyance condition.

Still, another object of this invention is to provide a target projecting apparatus having a projector actuator and control assembly being connectable to a conventional cigarette lighter outlet on a motor vehicle to provide the necessary external electrical 12 volt D.C. power in order to operate a target conveyance assembly of this invention.

Still, one object of this invention is to provide a target projecting apparatus having a target drive assembly utilizing sprocket members connected through a drive chain member and an electrical motor to load and operate a throwing arm assembly having a tension spring member to provide the throwing release power source.

One other object of this invention is to provide a target projecting apparatus which is sturdy in construction; economical to manufacture; easily lifted and conveyed from one position to another; easy to operate; and substantially maintanance free.

Various other objects, advantages, and features of the invention will become apparent to those skilled in the art from the following discussion, taken in conjunction with the accompanying drawings, in which:

FIGURES OF THE INVENTION

FIG. 1 is a perspective view of the target projecting apparatus of this invention in a cocked, latched, usage condition;

FIG. 2 is a side elevational view of the target throwing apparatus of this invention illustrating movement of a target conveyance assembly and a support stand assembly in various movement positions as shown in dotted lines;

FIG. 3 is a top plan view of the latched target projecting apparatus of this invention;

FIG. 4 is a sectional view taken in direction of the arrows and along line 4—4 in FIG. 3;

FIG. 5 is a bottom plan view taken in direction of the arrows and along line 5—5 in FIG. 4;

FIG. 6 is a fragmentary sectional view taken in direction of the arrows and along line 6—6 in FIG. 4 illustrating a control switch assembly of this invention;

FIG. 7 is an enlarged fragmentary sectional view taken in direction of the arrows and along line 7—7 in FIG. 3 illustrating a lock feature of the support stand assembly of this invention;

FIG. 14 is a partial vertical sectional view taken in direction of the arrows and along the plane of line 14—14 in FIG. 11;

FIG. 15 is a side elevational view disclosing the unit in a cocked position;

FIG. 16 is a top plan view illustrating the crank shaft means in a cocked position;

FIG. 19 is a top plan view of the crank shaft means immediately after being released by the safety trip latch with the dotted line arrow representing the downward path of the crank safe means;

Figure 11:
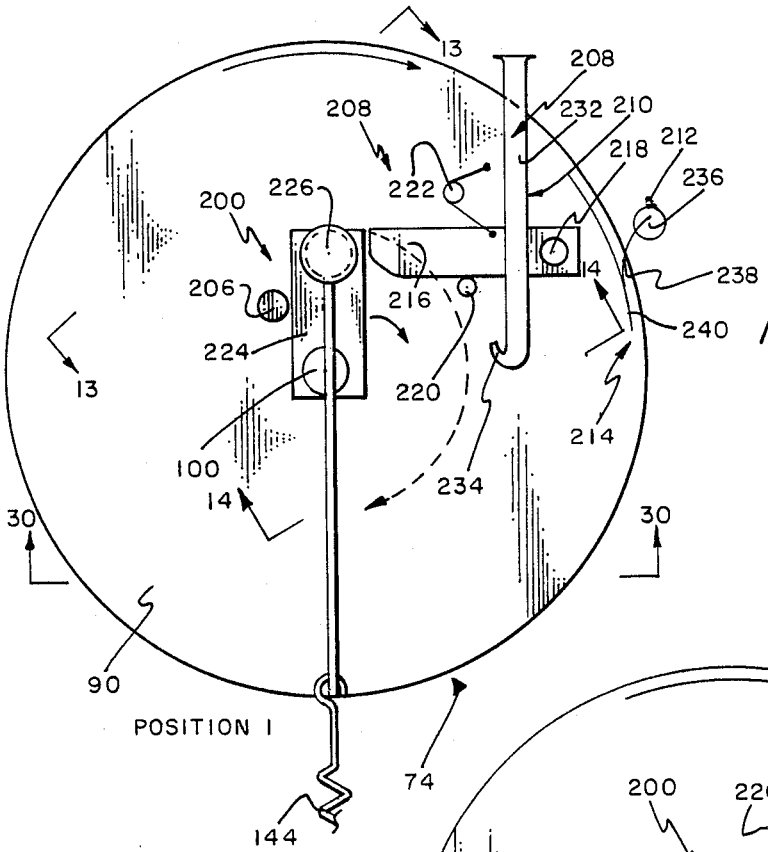
FIG. 11 is a top plan view of the crank shaft means engaged by the safety trip latch in a cocked position.
Figure 12:
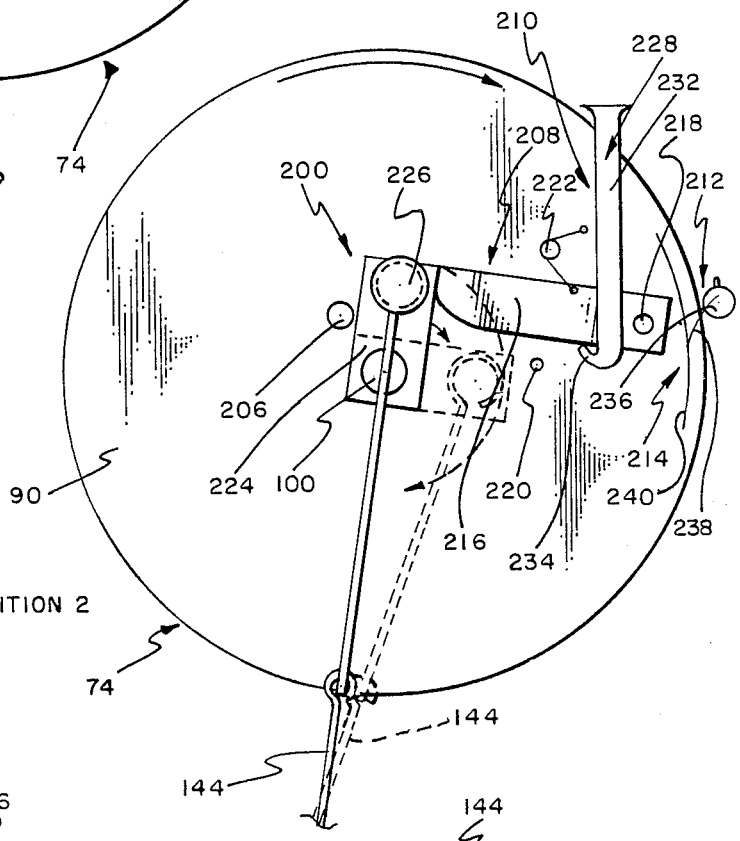
FIG. 12 is a top plan view of the crank shaft means being rotated by the sprocket into a tripping mode with the trip rod engaging the safety trip latch.
Figure 13:
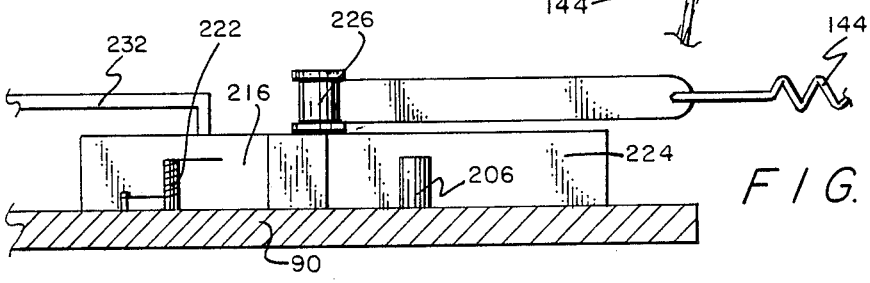
FIG. 13 is a partial vertical sectional view taken in direction of the arrows and along the plane of line 13—13 in FIG. 11.
Figure 17:
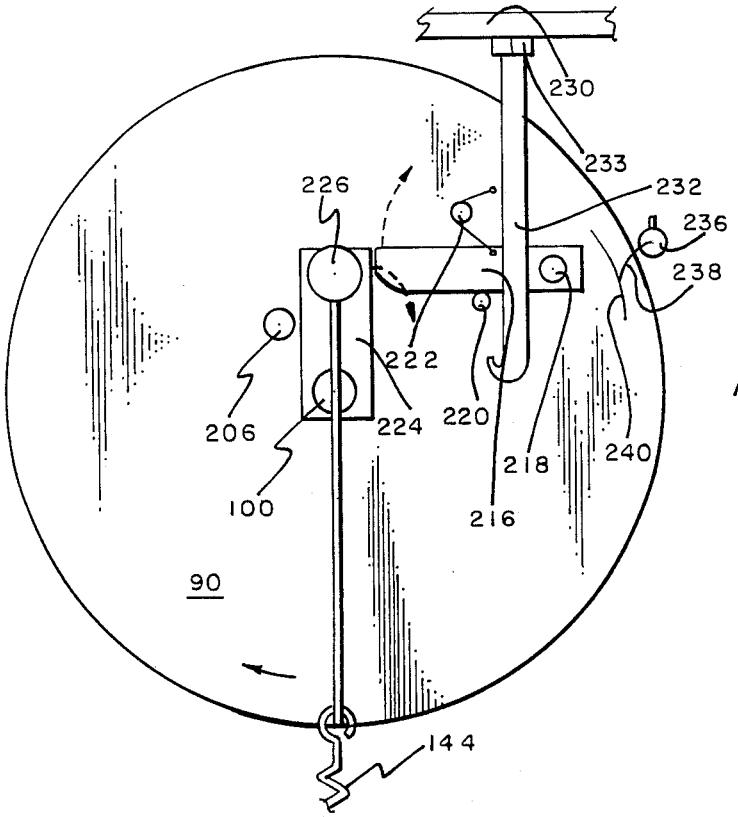
FIG. 17 is another top plan view depicting the crank shaft means in a cocked, ready to fire, position.
Figure 18:
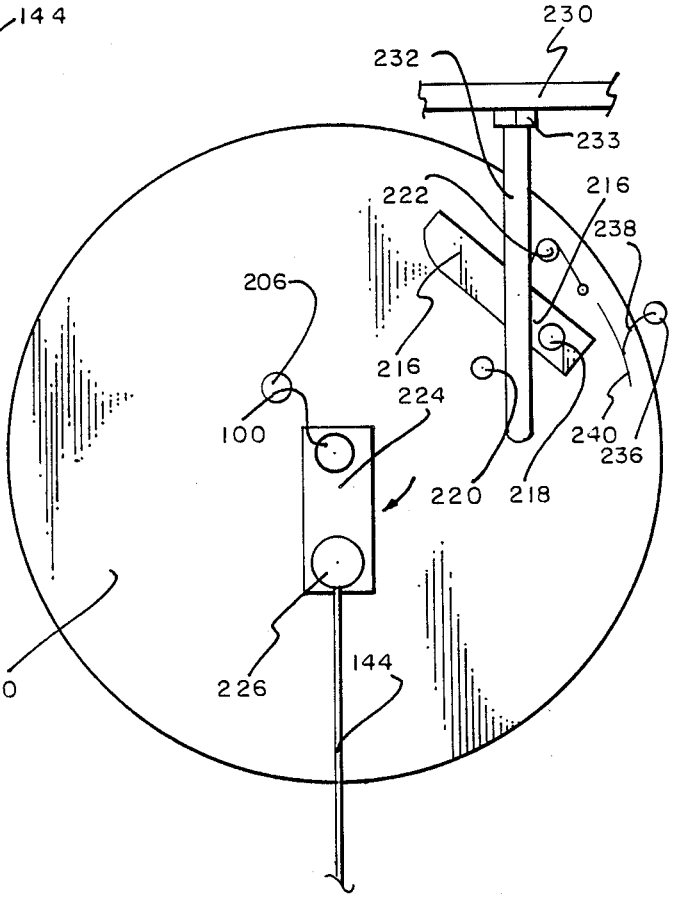
FIG. 18 is a top plan view illustrating the crank shaft means in a tripped, fired or released, position.
Figure 27:
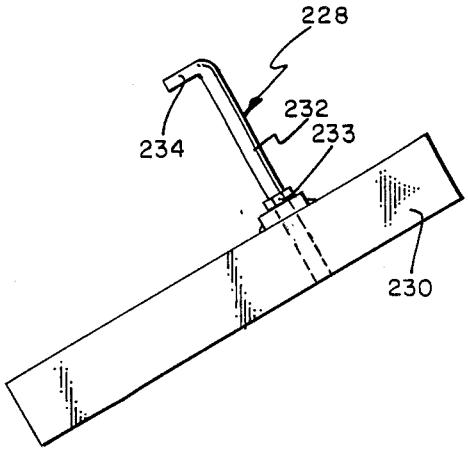
Figure 28:
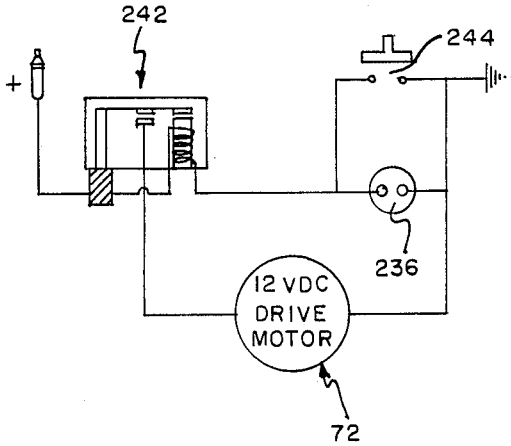
Figure 29:
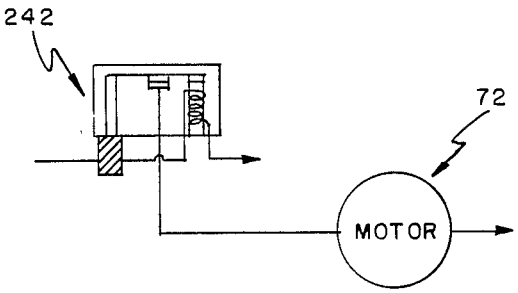
Figure 30:
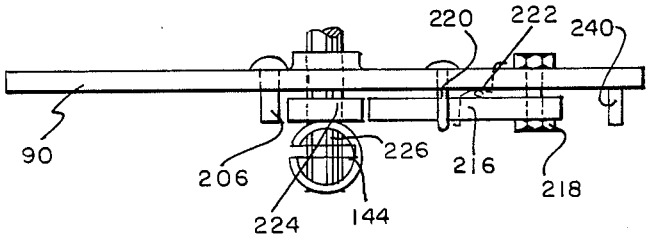

FIG. 20 is a top plan view of the crank shaft in the lowermost released position with the dotted line illustrations of the safety trip latch representing the various positions of the safety trip latch as it moves around the crank shaft means through rotation of the sprocket to lock the crank shaft against the drive lug such that the crank shaft begins to rotate with the sprocket and the attached thereto safety trip latch;

FIG. 21 is a top plan view of trip rod in various dotted line positions with respect to the safety trip latch and the engaged crank shaft mean;

FIG. 22 is a top plan view of the trip rod in Postion A from FIG. 21 with respect to the safety trip latch and the engaged crank shaft means;

FIG. 23 is a top plan view of the trip rod in Position B from FIG. 21 with respect to the safety trip latch and the engaged crank shaft means;

FIG. 24 is a top plan view of the trip rod in Position C from FIG. 21 with respect to the safety trip latch and the engaged crank shaft means;

FIG. 25 is a perspective view of the switch actuator strip engaged to the switch arm of the micro switch;

FIG. 26 is a perspective view of the trip rod;

FIG. 27 is a side elevational view of the trip rod engaged to the anchor post;

FIG. 28 is a schematic wiring diagram where the relay is in an open position with no current flowing to the motor from the switch arm of the micro switch engaged to the switch actuator strip;

FIG. 29 is a partial schematic wiring diagram where the relay is in a closed position with current flowing to the motor from the remote switch engaged or closed, or from the switch arm of the micro switch being disengaged from the switch actuator strip;

FIG. 30 is a vertical sectional view taken in direction of the arrows and along the plane of line 30—30 in FIG. 11;

FIG. 31 is a vertical sectional view of the solid line representation from FIG. 20 of the crank shaft tripped and taken in direction of the arrows and along the plane of line 31—31 in FIG. 20;

FIG. 32 is a vertical sectional view from FIG. 20 of the dotted line representation of position 2 of the safety trip latch and the solid line representation of the crank shaft and taken in direction of the arrows and along the plane of line 32—32 in FIG. 20;

FIG. 33 is a vertical sectional view from FIG. 20 of the dotted line representation of position 3 of the safety trip latch and the solid line representation of the crank shaft and taken in direction of the arrows and along the plane of line 33—33 in FIG. 20;

FIG. 34 is a top plan view of the crank shaft means being biased against the drive lug means as the drive lug means is driving the shaft means towards the cocked position; and FIG. 35 is a top plan view of the cocked position with the crank shaft mean being biased against the trip latch after release from being biased against the drive lug means.

The following is a discussion and description of preferred specific embodiment of the new target projecting apparatus of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail and, in particular FIG. 1, a target projecting apparatus of this invention, indicated generally at 12, is shown in the cocked, latched, usage condition and supported on a support surface 15. The support surface 15 could be the normal support ground, a table, a back of a pick-up truck, a roof of a building, or other desirable location.

The target projecting apparatus 12 of this invention is to be described and illustrated as readily attachable to a 12 volt DC system on a motor vehicle such through a cigarette lighter plug-in as such power source would be easily available to a person practicing the shooting of clay pigeons as will be described.

As noted in FIG. 1, the target projecting apparatus 12 includes (1) a main support housing assembly 14; (2) target drive assembly 16 mounted on the main support housing assembly 14; (3) a target conveyance assembly 18 connected to the target drive assembly 16 operable to receive and project a clay pigeon 19 therefrom; and (4) a projector actuator and control assembly 20 operably connected to the target conveyance assembly 18 and the target drive assembly 16 in order to automatically cock, load, and project the clay pigeons 19 therefrom.

The main support housing assembly 14 includes (1) a basic support frame 22; (2) a main cover assembly 24 mounted about and enclosing the basic support frame 22; and (3) a support conveyance assembly 26 connected to the basic support frame 22 to provide a means of varying the angle of incline and conveyance thereof. The basic support frame 22 includes end tube frame members 28 interconnected to upper and lower side wall members 30, 32. The end tube frame members 28 are interconnected by angle iron members 34 so as to achieve an overall rigid, rectangular frame assembly.

The main cover assembly 24 includes a top cover member 36; spaced, parallel side wall cover members 38; and spaced, parallel end wall cover members 40. It is noted that the numerous cover members 36, 38, and 40 mainly provide an outer shield and cover assembly about the basic support frame 22 so as to be both attractive in appearance and form a safety feature. Safety switches can be used to render the power supply inoperative if any cover member is removed. The main cover assembly 24 can be painted, constructed of stainless steel, or the like to achieve the desired end result.

The support conveyance assembly 26 includes (1) a support stand assembly 42 pivotally connected to the basic support frame 22; and (2) a handle member 44 secured to a support plate 46 which, in turn, is anchored between the upper end tube frame members 28 of the basic support frame 22.

The support stand assembly 42 includes (1) a stand housing 48; (2) a support leg assembly 50 pivotally mounted in the stand housing 48; and (3) an anchor assembly 52 mounted within the stand housing 48 and engagable with a portion of the support leg assembly 50 to hold in the desired storage or usage position. As noted in FIG. 7, the stand housing 48 includes a square tube member 54 having an anchor hole 53 therein.

The square tube member 54 is secured as by welding or the like to the outer surface of the lower side wall member 32 which has aligned holes therein to receive the support leg assembly 50 therethrough as will be explained.

The support assembly 50 include a pair of parallel leg member 56 interconnected at an upper end thereof by a connector shaft 58 which, in turn, has a handle assembly 60 secured to one end thereof. The parallel leg members 56 are provided with support cap members 62 which are preferrable constructed of a resilient rubber material to aid in holding the entire target projecting apparatus 12 in an upright, non-moving condition during a clay pigeon throwing operation.

As noted in FIGS. 2 and 4, the connector shaft 58 with interconnected leg members 56 is operable to be pivoted from the usage position as shown in FIG. 1 to a storage position as noted in FIG. 4.

The handle assembly 60 is provided with an L-shaped handle section 64 having a handle cover 66 mounted thereon. The handle section 64 is secured to the outer end of the connector shaft 58 and is operable, when pivoted, to move the support leg members 56 from storage to usage conditions.

The anchor assembly 52 includes a plurality of anchor holes 68 in the adjacent portion of the connector shaft 58 and a lock pin 70. The lock pin 70 is operable to be selectively engagable and movable within the holes 53, 68 to anchor the leg members 56 in one of two downwardly extended usage positions as shown in dotted line in FIG. 2.

A third anchor hole 68 is noted in dotted lines in FIG. 7 which is operable to hold the entire support leg assembly 56 in the storage or compact condition as noted in FIG. 4.

The handle member 44 is of a generally conventional U-shaped mounted in the center of the top area of the main support housing assembly 14 so as to provide balance in weight for each conveyance thereof. It is noted that the target conveyance assembly 18 covers the handle member 44 when in the loaded condition to prevent one from attempting to grasp and convey same in the loaded condition which would be very dangerous unauthorized practice.

The target drive assembly 16 includes (1) a main drive assembly 72; and (2) an actuator sprocket assembly 74 operably connected to the main drive assembly 72. The main drive assembly 72 includes a drive motor member 76 connected through a sprocket box member 78 to drive the actuator sprocket assembly 74 as will be noted. The drive motor member 76 includes a motor housing 80 and having an inlet power cord 82 connected thereto.

The sprocket box member 78 includes a drive shaft member 84 rotated by the drive motor member 76 in a desired speed due to the use of the sprocket box member 78.

The actuator sprocket assembly 74 includes (1) an initial drive sprocket member 86 mounted on the drive shaft member 84; (2) a drive chain member 88 mounted and driven by the initial drive sprocket member 86; (3) a driven sprocket member 90 having the drive chain member 88 mounted thereabout; and (4) a sprocket support assembly 92 having a bearing member 94 with a shaft member therein operable to rotatably support the driven sprocket member 90 in a manner to be explained. The sprocket support assembly 92 is connected to adjacent portions of the basic support frame 22 as by supports 93 so as to be not movable laterally or vertically but support the bearing member 94 therein.

The target conveyance assembly 18 includes (1) a main throwing arm assembly 96 mounted on a connector hub member 98 which, in turn, is secured to the upper end of a throwing shaft member 100. As noted in FIG. 9, the lower end of the throwing shaft member 100 is rotatably mounted within the bearing member 94 and anchored through a hole in a central portion of the driven sprocket member 90.

Figure 10:
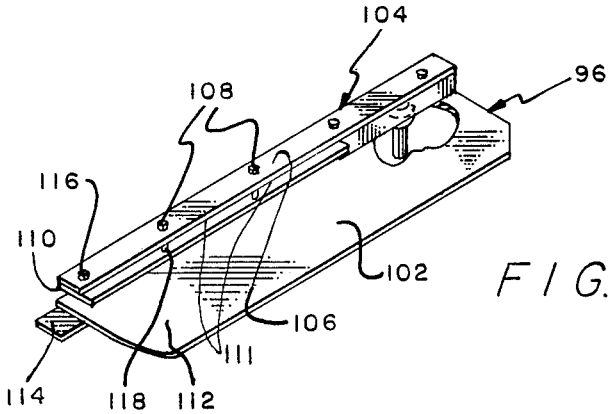
FIG. 10 is a perspective veiw illustrating a throwing arm assembly of this invention.

As shown in FIG. 10, the throwing arm assembly 96 includes (1) a base support plate member 102; and (2) a target support assembly 104 mounted on the base support plate 102. The base support plate member 102 of a generally rectangular shape having an upper surface to receive and support the clay pigeon members 19 thereon.

The target support assembly 104 includes (1) a top support plate member 106; (2) a plurality of connector members 108 to secure the top plate member 106 to the base support plate member 102; and (3) a resilient pad member 110 mounted against a lower surface of the top support plate 106 to provide a cushion effect on propelling the clay pigeon members 19.

The base support plate member 102 includes a main support body 112 having a latch projection portion 114 integral therewith. The function and operation of the latch projection portion 114 will be explained in detail.

The top support plate 106 is of a thin, rectangular bar type having the resilient pad member 110 secured to the lower surface thereof by the connector members 108. The connector members 108 include a plurality of nut and bolt members 116 and having spacer members 118 mounted between the top support plate 106 and the base support plate member 102 to provide the necessary spacing therebetween in order to receive the clay pigeon members 19 therebetween. The resilient pad members 110 operate to aid in cushioning the clay pigeon members 19 against impact shock as they are released from the target projecting apparatus 12 of this invention.

It is noted that the connector members 108 with the spacer members 118 are spaced from each other to create three (3) separate pocket target receiving areas indicated generally at 111 to receive the clay pigeon member 19 therein for throwing same at different distances and arcs of projection in a manner to be explained.

The projector actuator and control assembly 20 includes (1) an actuator cam assembly 120; (2) a power supply assembly 122 to provide electrical power supply to the main drive assembly 72; and 3) a control switch assembly 124 operable to automatically control releasing of the throwing arm assembly 96 in a manner to be explained.

Figure 8:
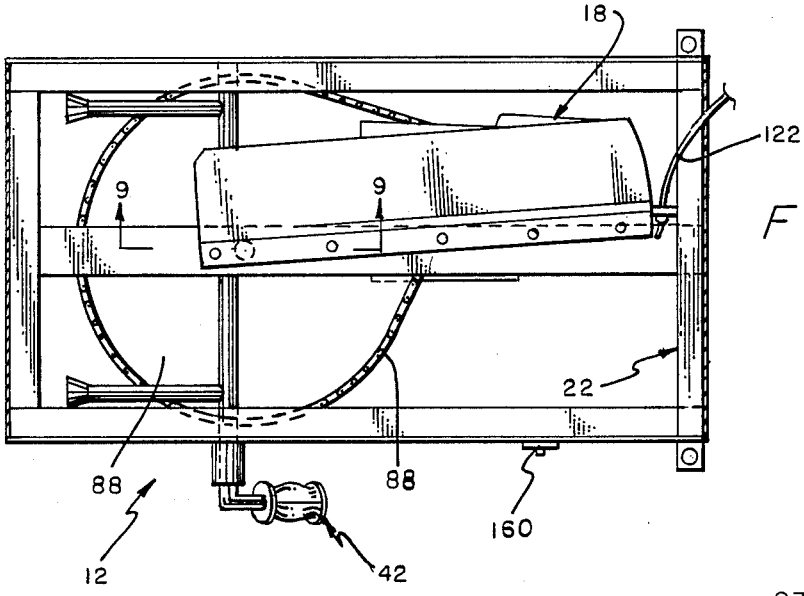
FIG. 8 is a top plan view similar to FIG. 3 except having an outer cover assembly removed to review positioning of various elements therein.
Figure 9:
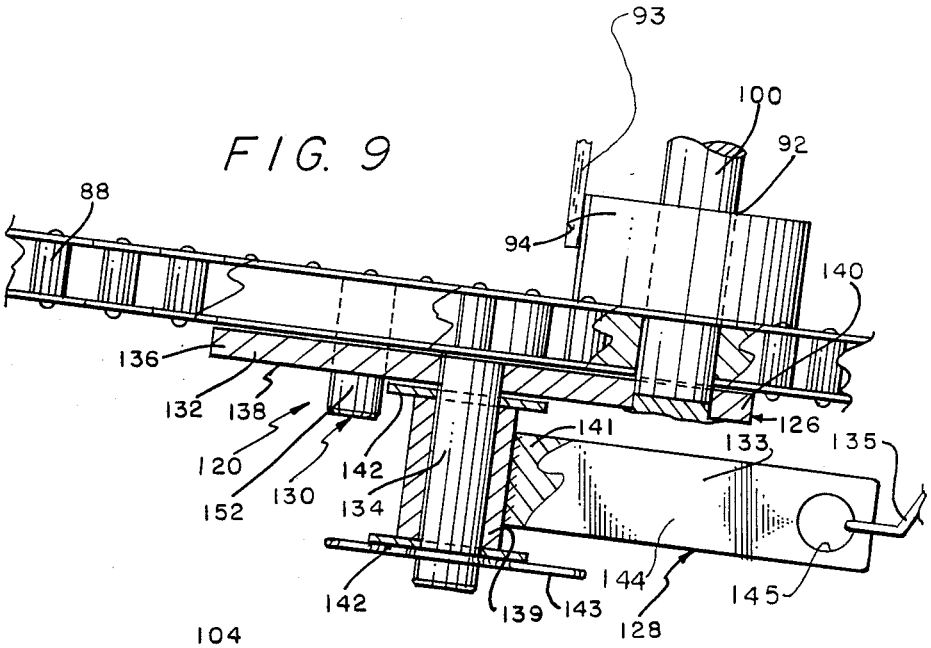
FIG. 9 is an enlarged fragmentary sectional view taken in direction of the arrows and along line 9—9 in FIG. 8.

As noted in FIG. 9, the actuator cam assembly 120 includes (1) a load arm assembly 126; (2) an arm power assembly 128; and (3) an actuator pin member 130. The load arm assembly 126 includes a load arm member 132 mounted on a power connector shaft 134. The load arm 132 includes an end portion 136 integral with a cam surface portion 138 which, in turn, is integral with a shaft connector portion 140 which is secured as by welding or the like to a lower end of the throwing shaft member 10 so that the load arm member 132 moves therewith as will be explained.

The power connector shaft 134 is secured as by welding at an upper end thereof through a hole in the load arm member 132 to provide the loading feature of this invention and subsequent rotational movement of the target arm assembly 96.

The arm power assembly 128 includes (1) a pivotal actuator arm 133 pivotally mounted about the power connector shaft 134; (2) a power member 135 connected at one end to the pivotal actuator arm 133 and the other end to the basic support frame 22; and (3) an anchor assembly 137 operable to connect the other end of the power member 135 to the basic support frame 22.

The pivotal actuator arm 133 includes a hub section 139; a connector arm portion 144 and spacer washer members 142 mounted on opposite sides of the hub section 139; and a lock member 143 to connect and hold the entire pivotal actuator arm 133 on the power connector shaft 134. It is seen that the arm power assembly 128 is rotatable on the power connector shaft 134 which is secured at the upper end to the load arm member 132.

The power member 135 is an elongated tension spring member 144 having one end pivotally connected by a hook portion through a hole 145 in the actuator arm 133 as clearly noted in FIG. 9.

The other end of the tension spring member 144 is pivotally connected to the anchor assembly 137. As best noted in FIG. 4, the anchor assembly 137 includes an eye bolt member 146 having its hook end portion connected to the tension spring member 144 and the opposite end extended through a hole in the basic support frame 22 and anchored against outward movement by a nut member 148 and having a washer member 150 therewith. The nut member 148 is threaded on the eye bolt member 146 to provide an adjustment feature.

The actuator pin member 130 which is secured to a lower surface of the driven sprocket member 90 in an off-set position relative to the center of the throwing shaft member 100. The anchor pin member 130 has an outer cam contact surface 152 which is engagable with the cam surface portion 138 of the load arm member 132 for movement in and out of the cocked or loaded position in a manner to be noted.

The inlet cord assembly 154, as noted in FIG. 1, includes a main electrical cord member 156 having a power supply member 158 secured to an outer end thereof. An inlet power source from the cord member 156 is controlled through an off/on switch member 160. The switch member 160 is used to control the supply of power to the entire target projecting apparatus 12 which would include the control switch assembly 124 and the main drive assembly 72. The safety switches on the main cover assembly 24 would similary disconnect the power supply.

The power supply member 158 is illustrated as a conventional cigarette lighter plug member which can be mounted within available cigarette lighter sockets to provide the necessary 12 volt DC power supply.

The control switch assembly 124 includes (1) a lever arm assembly 162 pivotally connected at one end to the basic support frame 22; and (2) a switch assembly 164 connected to the basic support frame 22 and operably engagable with the lever arm assembly 162.

The lever arm assembly 162 includes a pivotally connected lever arm member 166 having an actuator member 168 connected thereto. The lever arm member 162 is an elongated plate structure having an actuator end section 170 integral with an end section 172 and a switch actuator section 174 as noted in FIG. 6. The actuator end section 170 has the actuator member 168 connected thereto so as to be moved laterally and rearwardly as shown in dotted lines in FIGS. 4 and 6. The connector section 172 provides a pivotal connection the adjacent portion of the end tube frame member 28. The switch actuator section 174 is operable to be moved laterally as shown by the arrow 175 to actuate the switch assembly 164.

The actuator member 168 comprises a cord member 176 which is normally flexible and can be grasped for rearward movement of the lever arm member 166 as noted in dotted line in FIG. 4.

The switch assembly 164 includes a switch member 178 having an actuator plunger 179 moved axially by contact with the switch actuator section 174. The switch member 178 is connected by lines 180 and 182 to the power control switch 160 and the drive motor member 76 to control overall operation thereof as will be explained.

In general, the electrical control system of this invention has the power source initially supplied from the power supply member 158 through the on/off switch member 160 and any safety switches connected in series. The throwing arm assembly 96 control circuit is derived through the switch member 178 which, when closed, allows power to be supplied to the drive motor member 76 to rotate the driven sprocket member 90. Then, power to subject drive motor member 76 is interrupted on movement of the switch member 178 to the open condition achieved when the lever arm member 166 in the vertical position shown in solid lines in FIG. 6.

Referring in detail now to FIGS. 11–33 for an improved embodiment of the actuator sprocket assembly 74 of the target drive assembly 16, there is see a crank shaft means 200 that includes the throwing shaft 100 and is connected to the throwing arm assembly 66 through the throwing shaft 100. The actuator sprocket assembly 74 comprises the sprocket 90 which represents a sprocket support means. The sprocket 90 has an aperture 202 (see FIG. 15) wherethrough the throwing shaft 100 rotatably passes. Bearings 204 keep throwing shaft 100 aligned with respect to the aperture 202. Throwing shaft 100 rotates independently of the sprocket 90 and is not bound to the same. The target drive assembly 16 in addition to the actuator sprocket assembly 74 also includes the power means 72 attached to the main support housing assembly 14. The actuator sprocket assembly 74 in addition to the sprocket 90 comprises a drive lug 206 integrally bound thereto, and a means, generally illustrated as 208, secured to the sprocket 90 for latching and tripping the crank shaft means 200.

A releasing assembly, generally illustrated as 210, is secured to the basic support frame 22 for releasing the means 208 for latching and tripping and for controlling the acceleration of a target from the throwing arm assembly 96. A means, generally illustrated as 212, is secured to the basic support frame 22 for interrupting the power means 72 from rotating the sprocket 90. A means, generally illustrated as 214, is secured to the sprocket 90 for engaging periodically and activating the means 212 for interrupting the power means 72 from rotating the sprocket 90.

The means 208 secured to the sprocket 90 for tripping and latching the crank shaft means 200 preferably comprises a trip latch 216 pivotally secured at 218 to the sprocket 90, a stop pin 220 bound to the sprocket 90, and a spring means 222 secured to the trip latch 216 and to the sprocket for biasing the trip latch 216 against the stop pin 220.

The crank shaft means 200 additionally comprises a lever 224 integrally bound to the throwing shaft 100, a spring-attaching lug 226 integrally bound to the lever 216, and tension spring 144 secured to the spring-attaching lug 226 and to the basic support frame 22.

The releasing assembly 210 comprises a trip rod 228 that rotatably engages an anchor post 230 (see FIG. 27) which is attached to the basic support frame 22 of the main suport housing assembly 14. The trip rod 228 has a straight rod section 232 that is partially threaded at 234. The straight rod section 232 terminates in an end section 234 that is generally normal to the straight rod section 232. A locking nut means 233 rotatably and threadably engages the threaded sections at 234 of the trip rod 228 to screw against the anchor post 230 and lock the trip rod 228 from rotating.

The means 212 for interrupting the power means 72 from rotating the sprocket 90 is preferably a micro switch 236 having switch arm 238 and bound to the basic support frame 22 in close proximity to the sprocket and positioned such that the switch arm 238 can engage the means 214 for engaging periodically and activating the means 212 for interrupting the power means 72. The means 214 for engaging periodically and activating the means 212 for interrupting the power means 72 is preferably an arcuate strip member 240 bound to the sprocket 90 (see FIG. 25). Arcuate strip member 240 preferably defines an arc of from about 20 degrees to about 40 degrees.

Referring in detail now to FIGS. 28 and 29, the electrical diagram for the apparatus 12 of this invention comprises a relay 242 and a remote switch 244 electrically communicating with the power means 72 before the means for interrupting 212 (or micro switch 236) such that the remote switch 244 may override the micro switch 236 to start the sprocket 90 rotating. The micro switch 236 is normally closed which closes the relay 242 causing the power means 72 (i.e. drive motor 76) to rotate the sprocket 90. When the switch arm 238 engages the arcuate strip 240, the micro switch is opened, causing the relay 242 to open and terminate the flow of current to the drive motor 76. This stops the sprocket 90 from rotating, and as will be further discussed below, the crank shaft means 200 is in the cocked position. When it is desired to fire the apparatus 12, the remote switch 244 (which is normally open) is closed, by passing the micro switch 236 and causing the relay to close and supply electricity to the drive motor 76. This starts the sprocket 90 rotating again, causing the trip rod 228 to trip the safety trip latch 216 and release the crank shaft means 200 and propel the target through the air.

USE AND OPERATION OF THE INVENTION

In the use and operation of this invention, the target projecting apparatus 12 is operable to be folded into a compact position with the leg members 56 position underneath the main support housing assembly 14 and anchored by use of the lock pin 70 in this condition. The inlet cord assembly 154 can be stored in the main housing assembly 14 and the entire target projecting apparatus 12 can be moved by use of the handle member 44 from storage to a vehicle for conveyance to a target shooting area or the like.

On reaching an area so desired to throw clay pigeons, the support leg members 56 may be pivoted downwardly to a substantially vertical position or in an inclined position as noted in dotted lines in FIG. 2. In either of these positions, it is obvious that the lock pin 70 can be placed in a selected one of the anchor holes 68 for holding in the desired position of adjustment.

Next, the power supply member 158 can be plugged into a cigarette lighter receptacle or socket in a vehicle so as to supply the necessary 12 or 6 volt DC power supply to the target drive assembly 16 and the control switch assembly 124.

On initial operation of the target projecting apparatus 12, the on/off power supply switch 160 can be energized. With the target conveyance assembly 18 in the released condition, the drive motor member 76 is energized due to the fact that the switch member 178 is in the closed circuit condition. This would cause the actuator drive motor member 76 through the sprocket box member 78 to rotate the drive shaft member 84 and interconnected drive sprocket member 86. This, in turn, through connection of the drive chain member 88 would rotate the driven sprocket member 90.

As the sprocket member 90 rotates, this moves the off-set actuator pin member 130 with contact surface 152 into engagement with the cam surface portion 138 of the load arm member 132 as best noted in FIG. 9. This rotational movement is noted by the arrow 195 in FIG. 5 whereupon causes the power member 135 or tension spring member 144 to expand and provide a biasing force against the power connector shaft 134 to which is connected the load arm member 132.

On further rotational movement as noted by the arrow 195, the power connector shaft 134 achieves a position over dead center so as to bias the entire load arm member 132 towards a released position by the tension spring member 144. The target projecting apparatus 12 is held against release movement by abuttment of the latch projection 114 on the target support assembly 104 against he lever arm member 166 as noted in FIGS. 1 and 4. On reaching this position of abuttment, this causes the subject lever arm to move outwardly to position as shown in dotted lines in FIG. 6 which opens the switch member 178 and disconnects power to the drive motor member 76 to cease rotation of the sprocket member 90.

In this non-movement condition, the throwing arm assembly 96 is in the loaded condition ready for firing or releasing clay pigeon members 19 therefrom. Next, a clay pigeon member 19 is selectively mounted within one of the various slots 48 in the target support assembly 104 depending on the distance and arc desired to be taken by the clay pigeon member 19 during the actual throwing operation. For a target release operation, the cord member 176 is pulled rearwardly to move the entire lever arm 166 rearwardly as noted in dotted lines in FIG. 4. At this time, the subject lever member 166 moves out of contact with the latch projection 114 which, due to the off-set positioning of the power connector shaft 134, operates to pivot the throwing arm assembly 96 in a counterclockwise direction as noted in FIG. 1 to cause release action due to a force of the tension spring member 144. This causes a throwing action of the throwing arm assembly 96 to the released condition.

At this time, the lever arm member 166 thereupon moves to the solid line as shown in FIG. 6 which then closes the switch member 178 to again supply power through the connector lines 180, 182 to the drive motor member 76. This then proceeds to rotate the driven sprocket member 90 and the load arm assembly 126 to another loaded condition for subsequent throwing another clay pigeon member 19 therefrom.

It is obvious that this operation of continuously loading will proceed until selectively released and fired by pulling the cord member 176. The loading of the target projecting apparatus 12 will be automatic in operation after each clay pigeon throwing operation has been actuated.

With continuing reference to FIGS. 11–33 of the drawings for operation of the invention and the method for throwing a target (such as clay pigeons), the arcuate strip 240 is secured in proximity to the periphery of the sprocket 90 such that as the sprocket 90 rotates clockwise, it can engage the switch arm 238 and open the micro switch 236 to stop electrical power from flowing to the drive motor 76. As indicated, the micro switch 236 is normally closed, which closes the relay 242 and causes the drive motor 76 to rotate the sprocket 90. When the switch arm 238 engages the arcuate strip 240 being rotated into it by the rotating sprocket 90, the micro switch 236 is opened, causing the relay 242 to open and terminating power to the drive motor 76. This stops the sprocket 90 from turning, and the crank shaft means is in the cocked position of FIGS. 11, 12, 15, 16, 17, and 35.

As was previously mentioned, the crank shaft means 200 has a throwing shaft 100 that rotates through the aperture 202 of the sprocket 90 to connect to an end of the throwing arm assembly 96. Secured to the spring-attaching lug 226 that is integrally bound to the lever 224, is the tension spring 144 that constantly biases the crank shaft means downwardly, and is the major propulsion force for targets that have been positioned on the throwing arm assembly 96. When the crank shaft means 200 is released from the cocked position of FIGS. 11, 12, 15, 16, 17 and 35 by the tripping rod 228 elevating the safety trip latch 216, the tension spring 144 pulls the lever 224 of the crank shaft means 200 clockwise and downwardly to the tripped position of FIG. 18. As the released lever 224 is rotated clockwise with force from the tension of the tension spring 144, the throwing shaft 100 is likewise rotated clockwise with force, causing the throwing arm assembly 96 to swing forcefully clockwise to propel targets positioned thereon into the air. The crank shaft means 200 is now tripped into the position of FIG. 18, and the switch arm 238 of the micro switch 236 has been disengaged from the arcuate strip 240 which closes the micro switch 236 and the relay 242 and sends power to drive motor 76. When drive motor 76 has been energized, it rotates the sprocket 90 through the drive chain 88 encircling sprocket 90 and the motor driven drive sprocket 86.

After the crank shaft means 200 has been tripped, another target may be positioned on the throwing arm assembly 96, and the crank shaft means 200 may be returned to its cocked position. Preferably, the target is positioned on the throwing arm assembly 96 after the crank shaft means 200 is in a cocked position. The cocked position is obtained by the safety trip latch 216 latching the crank shaft means 200 such that the rotating sprocket 90 may rotate the spring biased crank shaft means 200. More specifically, after the crank shaft means 200 has been released (see FIG. 19), the sprocket 90 continues to rotate, causing the safety trip latch 216 to rotate therewith and slip around the end section 234 of the tripping rod 232, as indicated in FIG. 19. After the safety trip latch 216 has slipped away from engagement with the tripping rod 232, spring means 222 biases the safety trip latch 216 against the stop pin 220, as indicated in FIG. 20, and the safety trip latch 216 continues to rotate clockwise with the sprocket 90. As the safety trip latch 216 rotates clockwise, it passes through dotted line Position 1 into dotted line Position 2 in FIG. 20. In dotted line Position 2, the safety trip latch 216 encounters or touches the lever 224 of the tripped crank shaft means 200. The spring means 222 is weaker than the tension spring 144 and this forces the safety trip latch 216 to collapse away from the stop pin 220 and against the spring means 222, and move around the end of the lever 224 into Position 3 which is the position immediately before the safety trip latch 216 passes completely around the end of the lever 224 and engages the side of the lever 224, as indicated as Position 4 in FIG. 20. The sprocket 90 is continuing to rotate the safety trip latch 216, and when Position 4 is reached, spring means 222 snaps the safety trip latch 216 back against the stop pin 220; and at approximately the same time, the drive lug 206 arrives against the side of the lever 224 that is opposed to side that the safety trip latch 216 is engaging. The crank shaft means 200 including the lever 224 is now latched or locked in place against the drive lug 206 by the safety trip latch 216. The sprocket 90 is continuing to clockwise rotate, and now rotates clockwise not only the safety trip latch 216, but also the engaged or latched spring biased crank shaft means 200. As the sprocket 90 rotates clockwise (i.e. from about the 7 o'clock position of the lever 224 in FIG. 20 to the approximate 12 o'clock position of the lever 224 in FIGS. 11, 17 and 21) the tension spring 144 biases the crank shaft means 200 (i.e. more specifically the lever 224) against the drive lug 206 (See FIG. 34). At approximately the 12 o'clock position of the lever 224, the biasing of the lever 224 by tension spring 144 against the drive lug 206 is released, and tension spring biasing of the lever 224 is momentarily directly downwardly against the throwing shaft 100 (See FIGS. 11, 17 and 21). Momentarily in a preferred embodiment of the invention, with the continuing clockwise rotation of the sprocket 90, the tension spring biasing of the lever 224 is transferred from against the throwing shaft 100 to against the safety trip latch 216. (See FIGS. 12 and 35). Stated alternatively, the crank shaft means 200 is subsequently biased against the means for latching and tripping 208, and the throwing arm assembly is in the cocked position.

The sprocket 90 continues to rotate around clockwise until the switch arm 238 of the micro switch 236 engages the arcuate member 240. As was previously indicated, this causes the micro switch 240 to open, along with relay 242 and current to the drive motor 76 is terminated. When the drive motor 76 ceases to run, the sprocket 90 ceases to rotate and the projecting apparatus 12 is in the cocked position of FIGS. 11, 12, 15, 16, 17, and 35. The trip rod 232 should be threadably adjusted into the anchor post 230 (as illustrated in FIG. 21) such that the end section 234 is at the desired distance from the safety trip latch 216 after the same has ceased to rotate.

When it is desired to trip the cocked crank shaft means 200 (which in the cocked position should be slightly off dead center on the clockwise side and biased against the abutting end of the safety trip latch 216), the normally open remote switch 244 is closed by the user of the projecting apparatus 12, causing the by-pass of the micro switch 240 and the closing of the relay 242, and electricity is again supplied to the drive motor 76. This starts the sprocket 90 rotating again and drawing the safety trip latch 216 against the end section 234 of the tripping rod 232. As the sprocket 90 continues to rotate, the end section 234 causes the safety trip latch 216 to pivot at 218 upwardly or clockwise to compress spring 222 and the lever 224 is eventually released from engagement with the abutting end of the safety trip latch 216. The crank shaft means 200 has now been tripped, and the switch arm 240 of the micro switch 236 has now become disengaged from the arcuate strip 240, resulting in closure of the micro switch 240 and an energized drive motor 72 through the closure of relay 240. The energized drive motor 72 begins to rotate the sprocket 90 and the entire process may now be again repeated.

Another embodiment of this invention is the ability to control the acceleration of the target from the throwing arm assembly 96. Such control is accomplished through rotation of tripping rod 228 into the anchor post 230 to adjust the point of contact and the time when the end section 234 of the tripping rod 232 begins to engage the safety trip latch 216, causing the same to start collapsing away from the stop pin 220 and compress the spring means 222. Referring now to FIGS. 21–44, there is seen three potential positions for the tripping rod 232, more specifically, "Position A", "Position B", and "Position C". In Position A the tripping rod 228 has to be rotated into the anchor post 230 and shorten the effective length of the straight rod section 232. In Position A, as illustrated in FIG. 22, the safety trip latch 216 encounters or contacts the end section 234 of the tripping rod 228 sooner than in Positions B or C, where the effective length of the straight rod section 232 of the tripping rod 228 has been lengthened by rotating the tripping rod 228 out of or away from the anchor post 230. Position C could be an undesirable position to trip the crank shaft means 200 because the targets could be broken from a "whipping action" caused by loss of the gradual acceleration of the crank shaft means 200. Position A (see FIG. 22) enables the crank shaft means 200 to gradually accelerate after being tripped, whereas in Position C (see FIG. 24), there is no gradual acceleration of the crank shaft means 200 after it is tripped. As previously indicated, the locking nut means 233 screws against the anchor post 230 to lock the trip 228 from rotating when at the desired position.

It is seen that the target projecting apparatus of this invention provides a structure which is sturdy in construction, automatic in cocking operation, simple to operate, relatively economical to manufacture, and substantially maintenance free.

While this invention has been described in conjunction with preferred specific embodiments, it will be understood that this description is intended to illustrate and not to limit the scope of the invention, which is defined by the following claims:

I claim:

1. A target projecting apparatus adapted to receive, load, and throw targets such as clay pigeons and the like in a variable path, comprising (a) a main support housing assembly;

(b) a target conveyance assembly mounted to said main support housing assembly including a throwing arm assembly and a crank shaft means which is connected to said throwing arm assembly and includes a shaft;

(c) a target drive assembly connected to said main support housing assembly and comprising a sprocket support means having a structure defining an aperture wherethrough said shaft rotatably passes, power means secured in said main support housing assembly for rotating said sprocket support means, a drive lug means bound integrally to said sprocket support means, and a means secured to said sprocket support means for latching and tripping the crank shaft means;

(d) a releasing assembly secured to the main support housing assembly for releasing the means for latching and tripping and for controlling acceleration of a target from the throwing arm assembly; and (e) a means secured to said main support housing assembly for interrupting the power means from rotating the sprocket support means.

2. The target projecting apparatus of claim 1 additionally comprising means secured to said sprocket support means for engaging periodically and activating the means for interrupting the power means from rotating the sprocket support means.

3. The target projecting apparatus of claim 2 wherein said means for interrupting the power means from rotating the sprocket support means is a micro switch means bound to said main support housing assembly in proximity to said sprocket support means and positioned such as to engage the means for engaging periodically and activating the means for interrupting the power means from rotating the sprocket support means.

4. The target projecting apparatus of claim 3 additionally comprising a remote switch means electrically communicating with said power means before said means for interrupting such that said remote switch means may override the micro switch means to start the sprocket support means rotating.

5. The target projecting apparatus of claim 2 wherein said means secured to said sprocket support means for engaging periodically and activating the means for interrupting the power means from rotating the sprocket support means comprises an arcuate strip member bound to the sprocket support means.

6. The target projecting apparatus of claim 5 wherein said arcuate strip defines an arc of from about 20 degrees to about 40 degrees.

7. The target projecting apparatus of claim 1 wherein said means secured to said sprocket support means for tripping and latching the crank shaft means comprises a trip latch pivotally secured to said sprocket support means, a stop pin bound to said sprocket support means and a spring means secured to said trip latch and to said sprocket support means for biasing the trip latch against the stop pin.

8. The target projecting apparatus of claim 1 wherein said crank shaft means additionally comprises a lever integrally bound to the said shaft that rotatably passes through said aperture, a spring-attaching lug integrally bound to the lever, and a tension spring member secured to said spring-attaching lug and to said main support housing assembly.

9. The target projecting apparatus of claim 1 wherein said releasing assembly comprises a trip rod rotatably engaging the main support housing assembly, said trip rod having a structure defining a straight rod section which is partially threaded and terminating in an end section generally normal to said straight rod section.

10. The target projecting apparatus of claim 9 wherein said releasing assembly additionally comprising a locking nut means rotably and threadably engaging the threaded section of the trip rod to screw against the main support housing assembly and lock the trip rod from rotating.

11. The target projecting apparatus of claim 10 wherein said main support housing assembly has a basic support frame, and said releasing assembly is secured to said basic support frame, and said means for interrupting the power means from rotating the sprocket suport means is secured to said basic support frame.

12. The target projecting apparatus of claim 11 wherein said trip rod rotatably engages the basic support frame, and said locking nut screws against an anchor post that is included in the basic support frame.

13. A target projecting apparatus adapted to receive, load, and throw targets such as clay pigeons and the like in a variable path, comprising (a) a frame means;

(b) a crank shaft rotatably supported by said frame means;

(c) a throwing arm means mounted on one end of the crank shaft;

(d) a lever integrally bound to the other end of the crank shaft;

(e) a spring-attaching lug integrally bound to the lever;

(f) a tension spring member secured to the spring attaching lug and to the frame means;

(g) a sprocket support means having a structure defining an aperture wherethrough said crank shaft rotatably passes and supports said sprocket support means;

(h) drive means secured to the frame means for rotating the sprocket support means when engaged to a power source;

(i) a drive lug means bound integrally to said sprocket support means;

(j) a trip latch pivotally secured to the sprocket support means;

(k) a stop pin bound to said sprocket support means;

(l) a spring means secured to said trip latch and to the sprocket support means for biasing the trip latch against the stop pin;

(m) an arcuate strip member bound to the sprocket support means;

(n) a micro switch means bound to said frame means in proximity to said sprocket support means; and (o) a trip rod rotatably engaging the frame means, said trip rod has a structure defining a straight rod section and terminating in an end section generally normal to said strip rod section.

14. A method for throwing targets such as clay pigeons and the like in a variable path comprising the steps of:

(a) mounting on a sprocket support means a switch actuator strip means and a means for latching and tripping a spring biased crank shaft means rotatably passing through the sprocket support means and having secured thereto a throwing arm assembly;

(b) placing a target on, the throwing arm assembly;

(c) rotating the sprocket support means with a drive means engaged to a power source such that said means for latching and tripping latches the spring biased crank shaft means and rotates the same;

(d) interrupting the power source to the drive means to stop the sprocket support means from rotating; and (e) tripping the means for latching and tripping to release the latch on the spring biased crank shaft means such that the throwing arm assembly is propelled by the released spring biased crank shaft to throw the target, said tripping comprises overriding the interrupting of the power source to the drive means to restart the rotation of the sprocket support means causing said means for latching and tripping to rotate into a trip rod means rotatably mounted to a frame means.

15. The method of claim 14 additionally comprising controlling the acceleration of the target from the throwing arm assembly.

16. The method of claim 15 wherein said controlling comprises rotating the trip rod means to adjust the point of contact of the trip rod means with the means for latching and tripping.

17. The method of claim 15 wherein said interrupting comprises the switch actuator strip means being rotated by said sprocket support means into engagement with a micro switch means that is secured to said frame means.

18. The method of claim 17 wherein said terminating comprises disengaging the switch actuator strip means from the micro switch means by said sprocket support means being rotated away therefrom.

19. The method of claim 15 additionally comprising terminating the overriding causing said drive means to communicate with the power source to start the sprocket support means rotating.

20. The method of claim 14 wherein said rotating step (c) comprises biasing the spring biased crank shaft means against a drive lug means, releasing the biasing of the spring biased crank shaft from against the drive lug means, and biasing subsequently the spring biased crank shaft means against the means for latching and tripping.

* * * * *